US005197165A

United States Patent [19]

Zorzi et al.

[11] Patent Number: 5,197,165

[45] Date of Patent: Mar. 30, 1993

[54] LEVER STRUCTURE PARTICULARLY FOR SKI BOOTS

[75] Inventors: Claudio Zorzi, Silea; Valerio Tonel, Biadene; Giuseppe De Bortoli, Montebelluna, all of Italy

[73] Assignee: Nordica S.p.A., Montebelluna, Italy

[21] Appl. No.: 748,719

[22] Filed: Aug. 22, 1991

[30] Foreign Application Priority Data

Aug. 30, 1990 [IT] Italy ..... 59377/90[U]

[51] Int. Cl.[5] ..... A43C 11/00

[52] U.S. Cl. ..... 24/68 SK; 24/69 SK

[58] Field of Search ..... 24/68 SK, 69 R, 69 SK, 24/70 SK, 71 SK, 271; 36/50

[56] References Cited

U.S. PATENT DOCUMENTS

| | | | |
|---|---|---|---|
| 627,987 | 7/1899 | Dick | 24/271 |
| 2,441,113 | 5/1948 | Kinzl | 24/68 SK |
| 3,173,182 | 3/1965 | Teufel | 24/68 SK |
| 3,182,366 | 5/1965 | Teufel | 24/68 SK |
| 3,545,106 | 12/1970 | Martin | 36/50 |
| 4,682,426 | 7/1987 | De Marchi | 24/68 SK |
| 4,706,393 | 11/1987 | Marxer | 24/68 SK |
| 4,893,384 | 1/1990 | Biddia et al. | 24/70 SK |

FOREIGN PATENT DOCUMENTS

| | | | |
|---|---|---|---|
| 0079203 | 5/1919 | Austria | 24/69 CT |
| 3222383 | 1/1983 | Fed. Rep. of Germany | 24/69 SK |

*Primary Examiner*—Victor N. Sakran

*Attorney, Agent, or Firm*—Guido Modiano; Albert Josif

[57] ABSTRACT

A lever structure for securing one or more pressers and/or for closing the flaps of a ski boot, includes a device for the fine adjustment of the working length of one or more traction elements. The device includes at least one knob which can be accessed by the skier and is associated with a lever arm in an oscillating manner and without fixed connections. The knob has an internally threaded cavity which acts as seat for a complementarily threaded pawl which is rigidly associated with a traction element. The device is considerably simple in execution and has modest costs in view of the absence of pivots, rivets and other means for interconnection between the lever and the knob.

9 Claims, 2 Drawing Sheets

LEVER STRUCTURE PARTICULARLY FOR SKI BOOTS

BACKGROUND OF THE INVENTION

The present invention relates to a lever structure which is particularly usable for closing and/or tightening a ski boot and comprises a device for the fine adjustment of the working length of one or more traction elements.

In ski boots it is currently common to use levers to tighten one or more traction elements, such as cables or straps, which allow for example to secure one or more pressers arranged inside the boot or to close the flaps or the quarters of said boot.

In order to achieve an optimum securing or closure, it is known to use means suitable for finely adjusting the degree of tension of said traction elements.

On the subject, reference is made to a U.S. Pat. No. 3,173,182, filed on Jun. 3, 1963, claiming a German priority dated Dec. 5, 1962, which discloses a lever for ski boots which is pivoted, at one end, to a pair of shoulders which protrude from a first plate which is associated with a flap of the boot; said lever has, starting from said end, a longitudinal groove at which a pivot is transversely arranged; said pivot has a transverse hole within which the threaded end of a screw associated with a locking nut is slidingly arrangeable.

Said screw has, at the other end, a ring which selectively interacts with one of a plurality of teeth which protrude from a second plate which is associated with the other one of the flaps of the boot.

This solution, like others, has some disadvantages: first of all, it is composed of a large number of components which, since they must be mutually assembled, requires the intervention of specialized personnel, entails the execution of a larger number of operations required to compose the lever and thus has high manufacturing costs and times.

SUMMARY OF THE INVENTION

The aim of the present invention is therefore to eliminate the disadvantages described above in known types by providing a lever structure which allows the skier to achieve, in a rapid and easy manner, the optimum adjustment of the degree of securing or closure of the boot.

Within the scope of the above aim, another important object is to provide a lever structure which is structurally simple, can be easily industrialized and is economical from the point of view of manufacture.

Another important object is to provide a lever structure which stores the degree of adjustment preset by the skier after an opening of the lever.

Not least object is to provide a lever structure which associates with the preceding characteristics that of being reliable and safe in use.

This aim, these objects and others which will become apparent hereinafter are achieved by a lever structure particularly usable for securing a ski boot, comprising a device for the fine adjustment of the working length of at least one traction element, characterized in that said device comprises at least one knob which is associated with a lever arm in an oscillating manner and in the absence of fixed connections, said knob having at least one internally threaded cavity for a complementarily threaded pawl which is rigidly associated with said at least one traction element.

BRIEF DESCRIPTION OF THE DRAWINGS

Further characteristics and advantages of the invention will become apparent from the detailed description of some particular embodiments, illustrated only by way of non-limitative example in the accompanying drawings, wherein.

DESCRIPTION OF THE PREFERRED EMBODIMENTS

Figure 1:
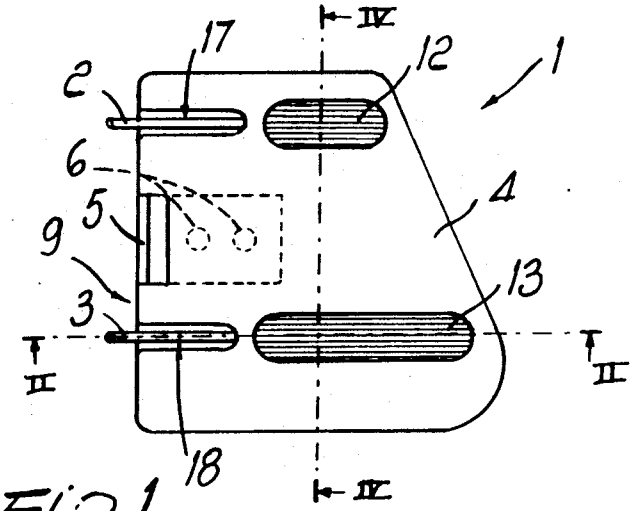
FIG. 1 is a top view of the lever structure wherein the device is applied to a single lever arm with which two distinct knobs are associated.
Figure 2:
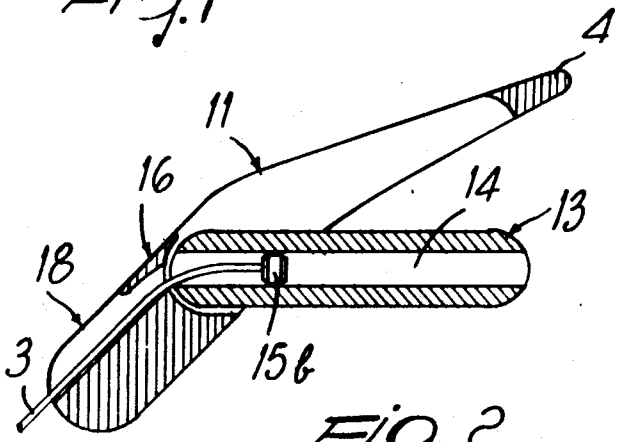
FIG. 2 is a sectional view of the lever structure, taken along the plane II—II of FIG. 1.
Figure 3:
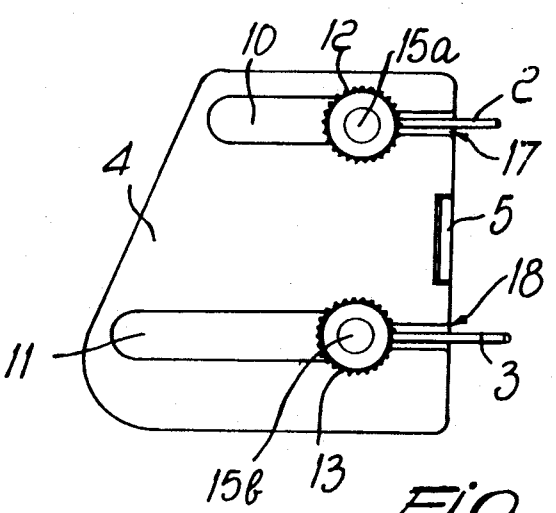
FIG. 3 is a side view of the lever structure with the adjustment device in the condition in which the knobs are orientated approximately at ninety degrees with respect to the lever arm.
Figure 4:
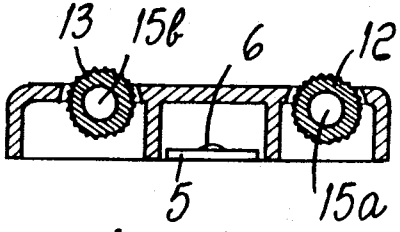
FIG. 4 is a sectional view of the lever structure, taken along the plane IV—IV of FIG. 1.
Figure 5:
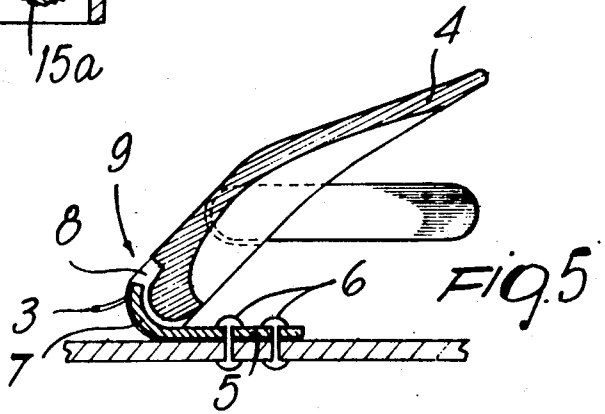
FIG. 5 is a partially sectional view of the lever arm, taken approximately at the longitudinal median plane, showing the interaction between said lever body and a plate which can be rigidly associated with a part of the boot.

With reference to the above figures, the numeral 1 indicates the lever structure which comprises the device for the fine adjustment of the useful length of one or more traction elements, such as for example cables and/or straps, indicated by the numerals 2 and 3, which is particularly usable for securing one or more pressers inside a ski boot and/or for closing the flaps or quarters of said boot.

The traction elements shall preferably but not necessarily be of the flexible type.

The lever structure is constituted, in the particular embodiment, by a single lever arm 4 which is associated with a part of the boot by means of a plate 5.

Said plate 5 is associated with a part of the boot by means of fastening members, or rivets, 6 and interacts with the lever arm 4 since it has a curved end 7 at which an end 9 of said lever arm 4 can be slidingly arranged at a first seat 8 which is also curved and preferably has a greater extension.

The greater extension of the first seat 8 allows to rotate the ever arm 4 with respect to the plane of arrangement of the plate 5 until the disengagement of said lever arm 4 from said plate 5 is achieved, beyond a certain angle of rotation.

Second through seats, indicated by the numerals 10 and 11, are defined at the lever arm 4 and accommodate a pair of knobs 12 and 13.

The configuration of each knob is advantageously cylindrical with rounded ends, whereas the second seats 10 and 11 are shaped complementarily to said knobs.

Said knobs have an axial cavity 14 which is internally threaded and interacts with a complementarily threaded pawl indicated by the numerals 15*a* and 15*b*.

The end of a traction element is rigidly associated with each pawl: the cable or strap 2 is connected to the pawl 15*a*, whereas the cable or strap 3 is connected to the pawl 15*b*.

The traction elements protrude from the respective knobs and pass through adapted channels 6 defined in the lever arm 4; said channels are adapted to connect the second seats 10 and 11 with third seats 17 and 18 defined longitudinally, and along the same axis as the second seats 10 and 11, with respect to the lever body 4 starting from the end 9 toward the knobs.

The use of the lever structure is as follows: after associating with each knob the pawl with the related traction element, it is sufficient to insert said traction element within the channels 16 in order to connect the knobs in an oscillating manner, but with no fixed connections, to the lever arm 4.

The degree of tension of each traction element can be adjusted by appropriately rotating the related knob, so as to allow the take-up or slackening of the traction element involved.

In order to perform this adjustment, the skier can advantageously act while the lever is open, extracting the required knob from the second seat: this extraction operation is allowed both by the configurations of the two parts and by the presence of the traction element which keeps the knob in position or at least guides its repositioning within the second seat.

The configuration of the ends of the knobs which interact with the corresponding facing ends of the second seats allows to rotate the lever body 4 with respect thereto without having to mutually connect them using pivots or similar means.

Figure 6:
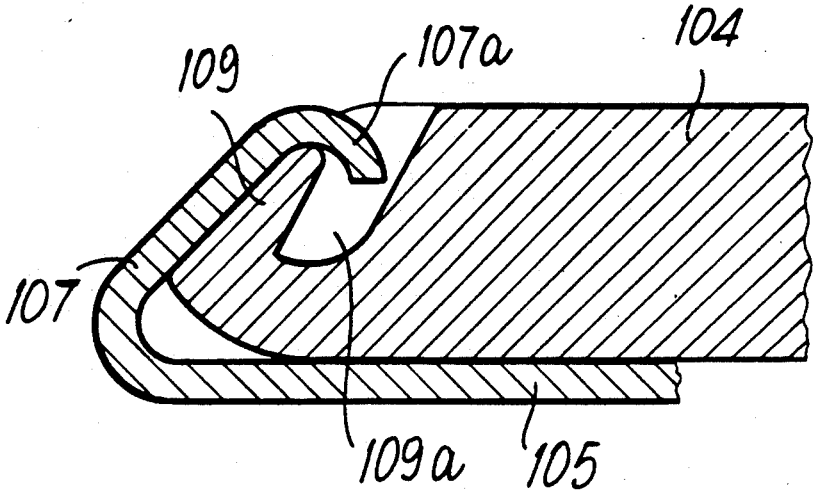
FIG. 6 is a view, similar to the preceding one, showing a lever arm and plate, according to a further aspect of the invention, in the closed position.
Figure 7:
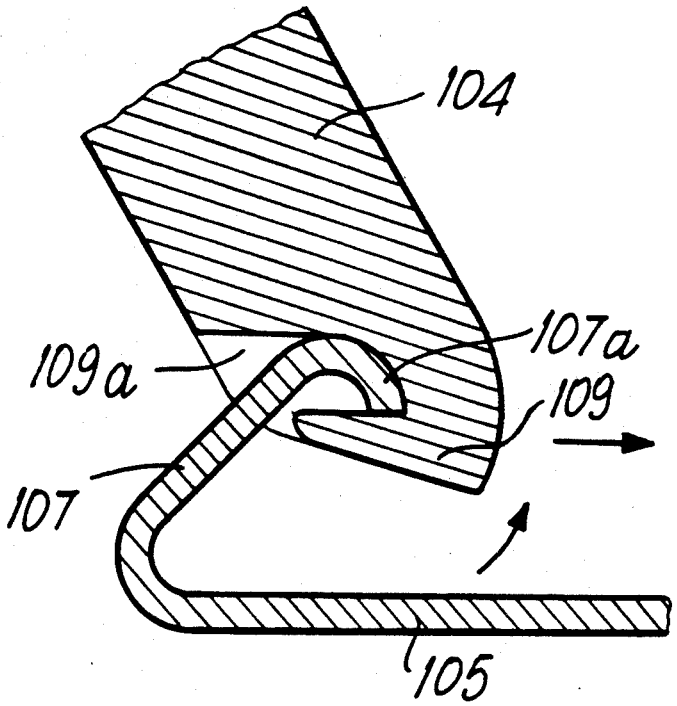
FIG. 7 is a view of the lever body and plate of FIG. 6, in the open position.

FIGS. 6 and 7 show a lever arm-plate assembly according to a further aspect of the invention, wherein plate 105, associated with the boot, has a curled portion 107 having a curl end 107*a*.

The lever arm 104 has a hook end 109, provided with a hook seat 109*a*, adapted to engage the curled portion 107 of plate 105.

As clearly shown in FIG. 7, the curl end 107*a* engages seat 109*a* of hook end 109, so that the lever arm 104 is advantageously held by plate 105 also in the open position. A complete disengagement of the lever 104 can be obtained by a combined translation and rotation of the lever.

It has thus been observed that the invention has achieved the intended aim and objects, a lever having been provided which allows the skier to optimally adjust, in a rapid and easy manner, the degree of securing or closure of the boot, and is at the same time structurally very simple and has modest manufacturing costs also by virtue of a considerable simplification with respect to its industrialization.

No fixed connection between the lever arm and the knobs is in fact present.

Finally, the lever according to the invention allows to store the degree of adjustment preset by the skier after an opening of the lever.

Naturally, one or more knobs can be associated with the lever arm, and the number and type of the traction elements may equally be the most appropriate according to the requirements.

If more than one knob is used, it is possible to consider an optional interconnection between the traction elements in order to achieve effort balancing during the tensing thereof.

The dimensions and materials which constitute the individual components of the structure may naturally be the most appropriate according to the specific requirements.

We claim:

1. Lever structure particularly usable for securing a ski boot, comprising:

a lever arm which is pivotally connectable to a portion of the ski boot and which is pivotally movable between an open and a closed position;

at least one traction element; and at least one adjustment device for finely adjusting the working length of said at least one traction element, said adjustment device comprising a knob element which is provided with an internal threaded cavity and a pawl element which is externally threaded and which is movably screwed in said internal threaded cavity, said at least one traction element being rigidly connected to said pawl element and exiting from said internal cavity thereof, said lever arm being provided with an accommodation seat for accommodating said knob element, said lever arm further being provided with a channel extending from said accommodation seat, said at least one traction element exiting from said internal cavity and extending through said channel, said knob element being lodged in said accommodation seat when said lever arm is in said closed position thereof without being connected to said lever arm, and said knob element being freely rotatable to adjust the working length of said traction element when said lever arm is in said open position thereof.

2. Lever structure according to claim 1, wherein said knob element has a cylindrical shape with rounded ends, said accommodation seat having at least one end arranged at said channel which is shaped complementary to one of said rounded ends of said knob element.

3. Lever structure according to claim 1, comprising a plurality of traction elements and a plurality of adjustment devices for finely adjusting the working lengths of said traction elements, each one of said plurality of adjustment devices comprising a respective said knob element which is lodged in a respective said accommodation seat of said lever arm without being connected to said lever arm in the closed position thereof and which is freely rotatable when the lever arm is in said open position thereof.

4. Lever structure particularly usable for securing a ski boot, comprising:

a lever arm which is pivotally connectable to a portion of the ski boot and which is pivotally movable between an open and a closed position;

at least one traction element; and at least one adjustment device for finely adjusting the working length of said at least one traction element, said adjustment device comprising a knob element which is provided with an internal threaded cavity and a pawl element which is externally threaded and which is movably screwed in said internal threaded cavity, said at least one traction element being rigidly connected to said pawl element and exiting from said internal cavity thereof, said lever arm being provided with an accommodation seat for accommodating said knob element, said lever arm further being provided with a channel extending from said accommodation seat, said at least one traction element exiting from said internal cavity and extending through said channel, said knob element being lodged in said accommodation seat when said lever arm is in said closed position thereof without being connected to said lever arm, and said knob element being freely rotatable to adjust the working length of said traction element when said lever arm is in said open position thereof, said lever arm (4) being removable pivoted to said portion of the ski boot by means of a plate (5) which is rigidly fixed to said portion and which is provided with a curved end (7), said curved end of said plate protruding from said portion and being accommodated in a seat (8) provided at one end (9) of said lever arm.

5. Lever structure according to claim 4, wherein said knob element has a cylindrical shape with rounded ends, said accommodation seat having at least one end arranged at said channel which is shaped complementary to one of said rounded ends of said knob element.

6. Lever structure according to claim 4, comprising a plurality of traction elements and a plurality of adjustment devices for finely adjusting the working lengths of said traction elements, each one of said plurality of adjustment devices comprising a respective said knob element which is lodged in a respective said accommodation seat of said lever arm without being connected to said lever arm in the closed position thereof and which is freely rotatable when the lever arm is in said open position thereof.

7. Lever structure particularly usable for securing a ski boot, comprising:

a lever arm which is pivotally connectable to a portion of the ski boot and which is pivotally movable between an open and a closed position;

at least one traction element; and at least one adjustment device for finely adjusting the working length of said at least one traction element, said adjustment device comprising a knob element which is provided with an internal threaded cavity and a pawl element which is externally threaded and which is movably screwed in said internal threaded cavity, said at least one traction element being rigidly connected to said pawl element and exiting from said internal cavity thereof, said lever arm being provided with an accommodation seat for accommodating said knob element, said lever arm further being provided with a channel extending from said accommodation seat, said at least one traction element exiting from said internal cavity and extending through said channel, said knob element being lodged in said accommodation seat when said lever arm is in said closed position thereof without being connected to said lever arm, and said knob element being freely rotatable to adjust the working length of said traction element when said lever arm is in said open position thereof, said lever arm (104) being removable pivoted to said portion of the ski boot by means of a plate (105) which is rigidly fixed to said portion and which has a curled portion (107) protruding from said portion and ending with a curled end (107*a*) which extends back toward said portion, said lever arm being provided with a hook end (109) which defines a hook seat (109*a*) in which said curled end (107*a*) is removably engaged.

8. Lever structure according to claim 7, wherein said knob element has a cylindrical shape with rounded ends, said accommodation seat having at least one end arranged at said channel which is shaped complementary to one of said rounded ends of said knob element.

9. Lever structure according to claim 7, comprising a plurality of traction elements and a plurality of adjustment devices for finely adjusting the working lengths of said traction elements, each of one of said plurality of adjustment devices comprising a respective said knob element which is lodged in a respective said accommodation seat of said lever arm without being connected to said lever arm in the closed position thereof and which is freely rotatable when the lever arm is in said open position thereof.

* * * * *